United States Patent [19]

Rochon et al.

[11] 4,408,486

[45] Oct. 11, 1983

[54] BELL NIPPLE DENSITOMETER METHOD AND APPARATUS

[75] Inventors: Robert W. Rochon; Joe W. Sneed, Jr., both of San Antonio, Tex.

[73] Assignee: Monarch Logging Company, Inc., San Antonio, Tex.

[21] Appl. No.: 431,718

[22] Filed: Sep. 30, 1982

Related U.S. Application Data

[63] Continuation of Ser. No. 186,496, Sep. 12, 1980, abandoned.

[51] Int. Cl.[3] ..... E21B 47/06

[52] U.S. Cl. ..... 73/155

[58] Field of Search ..... 73/155, 438, 439, 153; 175/40, 48

[56] References Cited

U.S. PATENT DOCUMENTS

| | | | |
|---|---|---|---|
| 1,761,295 | 6/1930 | Greenfield | 73/439 X |
| 2,434,098 | 1/1948 | Bags | 73/438 |
| 2,746,292 | 5/1956 | Vetter | 73/205 |
| 3,182,510 | 5/1965 | Melchior | 73/438 |
| 3,827,295 | 8/1974 | Rochon et al. | 73/155 |
| 3,911,741 | 10/1975 | Rochon et al. | 73/153 |
| 4,274,283 | 6/1981 | Maus et al. | 73/153 |

*Primary Examiner*—Jerry W. Myracle

*Attorney, Agent, or Firm*—Cox & Smith Inc.

[57] ABSTRACT

A method and apparatus for continuously determining the amount of entrained gasses and drilling fluid before the entrained gas is released to the atmosphere whereby differential pressures at vertically spaced locations in a bell nipple are monitored to determine changes in the weight of drilling fluid due to entrained gasses.

5 Claims, 1 Drawing Figure

BELL NIPPLE DENSITOMETER METHOD AND APPARATUS

This is a continuation, of application Ser. No. 186,496, filed Sept. 12, 1980 now abandoned.

BACKGROUND OF THE INVENTION

This invention relates to a method and apparatus for detecting and determining the amount of gas contamination of drilling mud and for measuring the amount of entrained gas in the drilling mud.

It has long been recognized that during drilling operations it is desirable to detect changes in the conditions in the formation at the lower portion of a drilling stem and in the borehole. In particular, it is well known in the art that it is necessary to maintain proper mud weight during drilling to obtain maximum drilling penetration and safety from blow-outs. Numerous attempts have been made to provide measurements of the amount of gas contamination of drilling fluids. In particular, U.S. Pat. No. 3,827,295 issued to the inventors herein on Aug. 6, 1974 discloses a device which gives continuous indications of changes in the condition at the bottom of the well. This device is useful in that it helps forewarn of difficulties or problems. Another type of device for determining the amount of changes in the drilling mud is shown in U.S. Pat. No. 3,911,741 issued to the same inventors herein on Oct. 14, 1975. This patent discloses a device for weighing the drilling mud after it has exited the bell nipple and discharge flow line and has been directed to the shaker box or the suction tank. U.S. Pat. Nos. 3,827,295 and 3,911,741 are incorporated herein in toto by this specific reference thereto.

As will be apparent, the above U.S. Pat. No. 3,911,741 discloses determining mud weight after it has exited the well. As will be apparent, entrained gases may have escaped, having been released to the atmosphere. Accordingly, it may not give an accurate measurement of what is actually going on in the well. In order to determine the weight of the mud in the mud column exiting from a well prior to the entrained gases being released, it is necessary that measurements be taken below the level of the mud at the top of the well, which is below the level of atmospheric pressure. The relationship of downhole containment pressures and reservoir pressures is the most important and dominant factor which affects the amount of gas which is mixed with the mud either from gas being flushed into the formation or gas which is drilled up with the gas bearing formation or, gas which is producing into the mud. It is therefore necessary to accurately determine the mud weight at the bottom of the well and the mud weight at the top of the well prior to escape of entrained gases. A comparison of these two weights provides a measure of the actual volume of gas in the mud. In this connection, Applicants have invented a method and apparatus for determining mud weight and gas content. It is an object of the invention to overcome problems found in the prior art and provide an accurate means for quantitatively analyzing the mud prior to exiting the bell nipple and before the escape of entrained gases. This provides an analysis based on the actual conditions of the mud based on what is actually going on in the well base and in the formations drilled.

SUMMARY OF THE INVENTION

A new and improved method and apparatus for continuously deteriming the amount of entrained gas in drilling fluid before the entrained gas is released to the atmosphere whereby bell nipple is connected with the borehole to directly receive drilling fluid flowing through the borehole; first and second vertically spaced monitoring means are connected with the bell nipple to continuously monitor changes in the pressure of the drilling fluid at the vertically spaced location in the bell nipple before any entrained gases are released to the atmosphere. A means for displaying changes in the differential pressure is at the vertically spaced location to determine changes in the weight of the drilling fluid due to the entrained gases. The vertically spaced locations are in the order of 8.35 inches apart so that a change of one pound per gallon in the drilling fluid is reflected as a differential pressure of one inch of water.

DESCRIPTION OF THE PREFERRED EMBODIMENT

Figure 1:
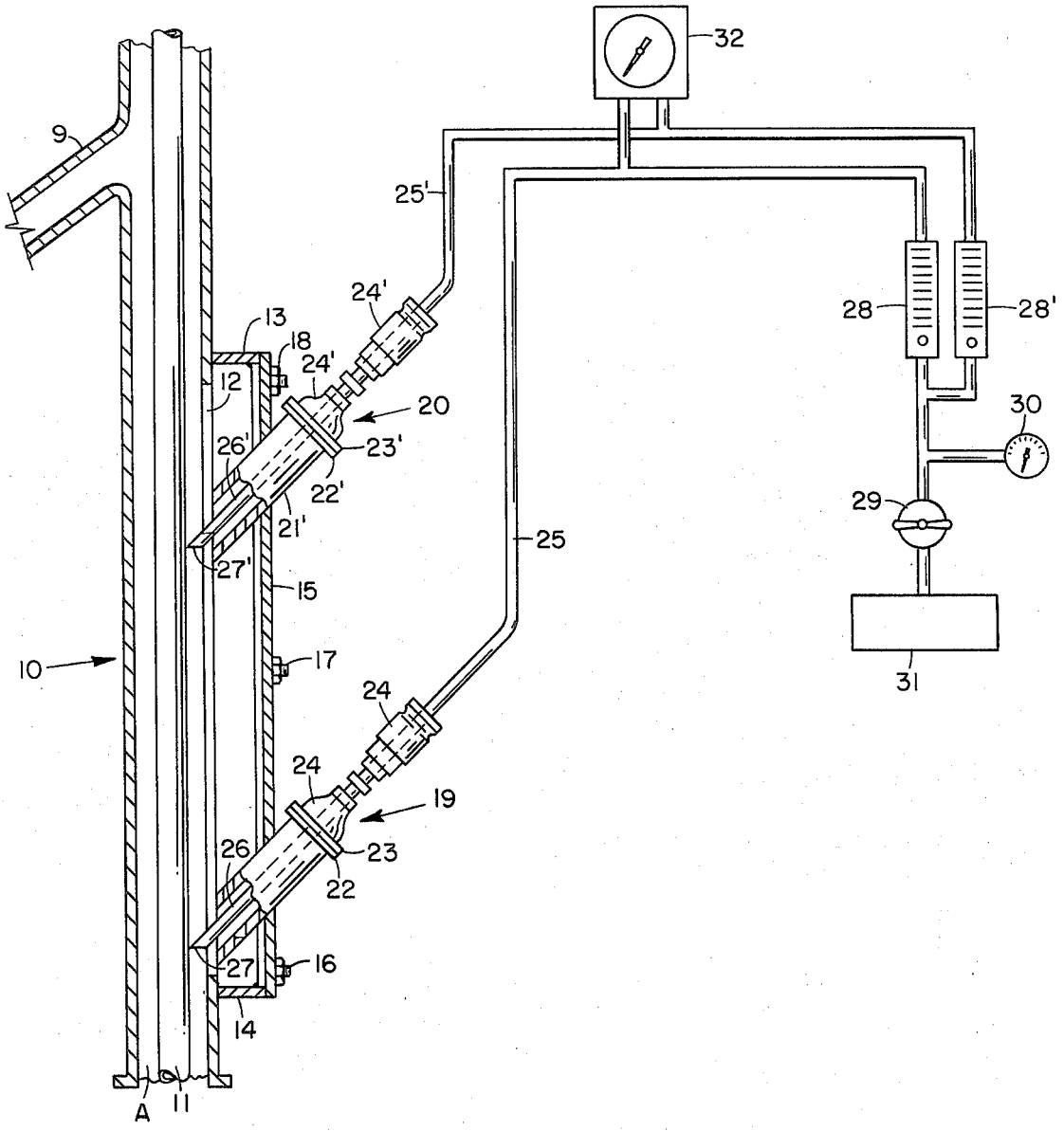
FIG. 1 is an elevation view showing partly end section the apparatus of the invention which is used in practicing the method of the invention also.

In FIG. 1 of the invention a bell nipple 10 is schematically shown. This device utilized is similar to the bell nipple disclosed in U.S. Pat. No. 3,827,295 and is known in the prior art so no further discription is provided. Extending through the bell nipple monitor is a drilling stem 11 as is also well known in the art. The bell nipple 10 has an outlet opening which communicates with a flow line 9.

An opening 12 is provided in the bell nipple and is enclosed by a housing 13. The housing 13 includes a side wall 14 which surrounds the opening 12. A plate 15 is sealingly secured to the side wall 14 by suitable means such as studs and taps 16, 17 and 18. Other suitable means could be used to secure the plate 15 in sealing arrangement with the side wall portion 14.

Sealingly mounted with the plate 15 are monitoring means 19 and 20. The monitoring means 19 and 20 are identical in construction so a detailed description will be given in connection with the monitoring means 19. Similar components on the monitoring means 20 are given identical reference numerals with the addition of the prime superscript.

The monitoring means 19 includes a tubular housing 21 which is sealingly mounted on the plate 15. The housing 21 is preferably mounted at a 45° angle to the bell nipple 10 so that it will be self-draining. A flange 22 is provided at the upper end of the housing 21. The flange 22 is adapted to be sealingly connected to the flange 23 which is connected to a sealing cap 24. A union 24 is provided which connects an air supply conduit 25 to a pipe 26. The pipe 26 terminates in an opening 27 at its lower end and extends into the annulus A through which drilling mud returning from the bottom of the well returns to the surface.

The monitoring means 20 is identical in construction to the monitoring means 19 and corresponding components have been numbered accordingly. These monitoring devices function similar to the monitoring means disclosed in U.S. Pat. Nos. 3,827,295 and 3,911,471 and are more fully explained hereinafter. The monitoring or sensing devices 19 and 20 are specifically placed relevant to each other and to the flow discharge line flowing mud out of the bell nipple 10. It is important that these monitoring devices be positioned below the flow discharge line for accurately measuring the gas entrained in the mud prior to its loss. It is also desirable that the openings 27 and 27' be spaced 8.35 inches apart so that the differential pressures between these two sensing points is automatically translated in terms of pounds per gallon of water.

The air supply conduit 25 includes a flow meter 28 to limit the volume of air flowing through the conduit and to the bell nipple 10. An air regulator 29 and pressure gage 30 is connected in the air supply conduits 25 between the air supply means and flow meter 28 to regulate the air pressure flowing to the flow meters. An additional flow meter 28' is provided for the air supply conduit 25'. Air is provided from a supply source 31 through the air regulator 29 and through the flow meters 28 and 28'. The air flows through the flow meters 28 and 28' and conduits 25 and 25' to the pipes 26 and 26'.

The device shown in FIG. 1 provides an apparatus whereby the pressure of the mud flow can be detected before it reaches the atmosphere and loses any entrained gases. Since a gallon of water weighs 8.35 pounds, a change of one pound per gallon in the drilling fluid is reflected as a differential pressure of one inch water. This differential pressure is reflected on the recording device 32 which may be calibrated to record drilling fluid weight changes as inches of water which is directly equal to the weight change in pounds of mud per gallon. When the weight of the drilling fluid exiting the bell nipple through the annulus A changes, the pressure differential at the ends 27 and 27' of the submerged tubes 26 and 26' changes directly and is proportional to the change of one inch of water pressure for each pound per gallon increase in the weight of the drilling mud. This provides a direct reading in pounds per gallon on a pressure differential recording device 32.

By this means, instantaneous and continuous mud weights can be provided before any entrained gases in the drilling mud are released. This is a true measure of the amount of entrained gas in the mud when these measurements are compared with the weight of the mud going into the well. These are dynamic mud weights and are very valuable in determining what the conditions are at the bottom of the well. When these change conditions are due to a gas flow, it provides an accurate measurement of the amount of gas entering the mud.

Any measurements or calculations are taken when the mud pumps are active and flowing mud through annulus A. Anomalies from gas entering the bore hole during pump shutdown are not comparable because the gas anomoly or size of kicks varies with pump downtime, pressure differentials and formation permeability. Because the point of measurement is in the bell nipple, all of the variables affecting gas units and shaker box mud weights at the surface have been eliminated.

The volume of gas entering the borehole and drilling mud is determined as follows. The gas entering the hole per minute (cu. ft./min.) equals the (pump volume times the mud weight and divided by the mud weight out) minus the pump volume. The mud weight in and pump volume can be easily determined. The instant invention accurately determines the mud weight out which enables an accurate determination of the volume of gas or percent gas in the mud exiting the borehole.

Although the foregoing invention has been described in conjunction with the foregoing specific embodiment, many alternatives, variations and modifications will be apparent to those of ordinary skill in the art. Those alternatives, variations and modifications are intended to fall within the spirit and scope of the appended claims.

We claim:

1. A method for continuously determining the amount of entrained gas in drilling fluid before the entrained gas is released to the atmosphere comprising the steps of:

flowing drilling fluid through the borehole;

continuously monitoring changes in the pressure of the drilling fluid at vertically spaced locations in a bell nipple connected with the borehole before any entrained gases are released to the atmosphere; and displaying changes in the differential pressures at the vertically spaced locations to determine changes in the weight of the drilling fluid due to entrained gases.

2. A method used during the drilling of a well for continuously determining the density of drilling fluid in a bell nipple below the flow line before entrained gas is released to the atmosphere comprising the steps of:

continuously monitoring differential pressure caused by changes in the density of the drilling fluid at vertically spaced locations below the flow line in the bell nipple; and displaying changes in the differential pressure to determine changes in the weight of the drilling fluid due to entrained gasses.

3. The method as set forth in claim 2, wherein:

the step of continuously monitoring includes monitoring at space locations in the bell nipple on the order of 8.35 inches apart.

4. An apparatus connected to a bell nipple below the flow line for continuously determining the density of a drilling fluid before the entrained gas is released to the atmosphere, comprising:

first and second vertically spaced monitoring means connected with the bell nipple for sensing differential pressure changes caused by changes in the density of drilling fluid before exiting the bore hole through a flow line in the bell nipple and any entrained gasses are released to the atmosphere; and means for displaying the changes in the differential pressure to continuously determine the weight of the drilling fluid immediately prior to exiting from the well bore.

5. The apparatus as set forth in claim 4 wherein:

said first and second vertically spaced monitoring means each including a pipe extending into the bell nipple connected to the said displaying means; and an air supply means provided for flowing air to each pipe.

* * * * *